United States Patent [19]

Samuels et al.

[11] Patent Number: 4,994,837

[45] Date of Patent: Feb. 19, 1991

[54] PROCESSOR WITH TEMPERATURE RESPONSIVE FILM TRANSPORT LOCKOUT

[75] Inventors: James T. Samuels; Roger D. Ellsworth, both of Rochester, N.Y.

[73] Assignee: Eastman Kodak Company, Rochester, N.Y.

[21] Appl. No.: 494,647

[22] Filed: Mar. 16, 1990

[51] Int. Cl.[5] ..... G03D 3/08

[52] U.S. Cl. ..... 354/299; 354/322

[58] Field of Search ..... 354/299, 319, 320, 321, 354/322

[56] References Cited

U.S. PATENT DOCUMENTS 3,832,730 8/1974 Geyken et al. ..... 354/299
4,153,363 5/1979 Albano ..... 354/299
4,240,737 12/1980 Lawson ..... 354/299
4,600,287 7/1986 Hotta et al. ..... 354/299

*Primary Examiner*—A. A. Mathews
*Attorney, Agent, or Firm*—G. Herman Childress

[57] ABSTRACT

An automatic film processor, sets new reference developer chemical temperatures and film transport speeds in accordance with user input at a keypad and disengages the film transport motor under microcomputer control to prevent further introduction of film until sensed actual developer temperature is within an acceptable tolerance of the new set temperature. A "wait" light is modulated to flash with increasing frequency as the gap between actual and set reference temperature is narrowed. Manual override is provided to re-engage the film motor even though the new set temperature has not been reached. A buzzer signals a feed in the override mode.

20 Claims, 3 Drawing Sheets

PROCESSOR WITH TEMPERATURE RESPONSIVE FILM TRANSPORT LOCKOUT

The present invention relates to processors of film and similar photosensitive media, in general; and, in particular, to a processor inc means to inhibit media transport if the processor are not within a predetermined temperature range.

BACKGROUND OF THE INVENTION

Photosensitive media processors, such as the Kodak X-OMAT processors, are useful in applications such as the automatic processing of radiographic films for medical imaging purposes. The processors automatically transport sheets or webs of photosensitive film, paper or the like (hereafter "film") from a feed end of a film transport path, through a sequence of chemical processing tanks in which the media is developed, fixed, and washed, and then through a dryer to a discharge or receiving end. The processor typically has a fixed film path length, so final image quality depends on factors including transport speed which determines length of time the film strip is in solution, and the temperature and composition of the processing chemicals (the processor "chemistry").

In a typical automatic processor of the type to which the invention relates, film transport speed is set at a constant rate and the chemistry is defined according to a preset recommended temperature, e.g. 93° F., with a specified tolerance range of +/− X° F. A temperature control system is provided in the processor to keep the chemicals within the specified range. The Kodak Model M6B X-OMAT Processor, for example, uses a thermowell located in the developer recirculation path to maintain a desired recommended developer chemical temperature. The thermowell has a cartridge heater inserted into one end of a hollow tubular body through which the developer is caused to flow by means of a pump. A thermistor protruding into the thermowell flow path serves to monitor the recirculating developer temperature and control the on-off cycle of the heater. The fixer, whose temperature is less critical, is maintained at a temperature close to the developer temperature by directing the developer recirculation path in a loop through the fixer tank. A standby mode is often provided for deactivating of at least a portion of the processor heating element during periods of inactivity, in order to conserve energy. During such periods, a "wait" light or other annunciator signals deviation from recommended running parameters so that new film is not inadvertently introduced until the system has been returned to its active mode.

Although conventional processors used for radiographic image processing are traditionally configured to operate at a constant film transport speed, modifications may be made through gear changes and the like to vary the process. Moreover, new processors are being introduced which are usable in more than one mode. The mode is often referred to in shorthand fashion by a nominal film transport "drop time", which may be defined as the time from entry of the leading edge of a sheet of film at the feed end until exit of the trailing edge of the same sheet of film at the discharge end. Conventional processors operate in standard (90 second), rapid (45 second), or "Kwik" (30 second) mode, and can be varied to operate in an extended-cycle mode, such as described in L. Taber & A. G. Hans, "Processing of Mammographic Films: Technical and Clinical Consideration," Radiology, Vol. 173, No. 1, pages 65–69, October 1989. In the latter mode, processor speed is lowered and chemistry temperature is raised to enhance image contrast for better detection of changes in density of fibrous tissue. The new processors will be settable as to transport speed and chemistry temperature (i.e., developer temperature) in order to be able to use the same processor for multiple processing modes.

If film is run through a processor during a change of mode, before the chemistry temperature has reached its new setting, the image development will be of substandard quality and, in worst case, not readable at all. For diagnostic imaging, this may necessitate retake with consequential patient inconvenience and additional radiation exposure. In cases of radiographic imaging utilized for progress monitoring purposes during a surgical operating procedure, this may lead to other undesirable consequences. Accordingly, it is desirable to be able to prevent processing of exposed photosensitive media until the processor chemicals are within a desired temperature range. It is, however, also desirable to be able to override any such lockout, such as where rapid development is of greater importance than good film quality.

SUMMARY OF THE INVENTION

It is an object of the present invention to provide a lockout system for the prevention of the introduction of exposed photosensitive media into an automatic processor when the temperature of the processor chemicals is outside a predetermined desirable temperature range.

It is another object of the present invention to provide an annunciator to signal the approach of and attainment of a predetermined desirable chemistry temperature range in an automatic processor configured to operate at a plurality of chemistry temperature settings.

It is a further object of the present invention to provide an automatic processor having means to lockout the introduction of photosensitive media for processing and means to optionally override such lockout means.

In accordance with the invention, a processor of exposed photosensitive media having means for automatically transporting film along a path through developer, fixer, wash and dryer stations and means for regulating the temperature of processor chemistry, further comprises means responsive to user input for setting system parameters including a desirable chemistry temperature, and means for inhibiting the introduction of fresh media into the processor unless actual chemistry temperature is within an acceptable range.

In one aspect of the invention, described in greater detail below, processor film transport speed and developer temperature are set according to user selection of a processor operating mode, and the film transport means is disabled after a change of mode until developer temperature is brought within the range for acceptable quality prints in the new mode. Means are provided to intentionally override the film transport lockout, where processing without delay is more important than processing quality.

In another aspect of the invention, "wait" and/or "ready" lights, or similar annunciators, are employed to signal that developer temperature is outside the recommended range. In a preferred embodiment, an annunciator is modulated at varying frequency to signal the approach of actual temperature to desirable temperature, so that a user can make a tradeoff judgment between wait time and picture quality. In a preferred embodiment, a "wait" light is made to blink faster and faster as the actual temperature approaches the desirable temperature.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

DETAILED DESCRIPTION OF THE PREFERRED EMBODIMENTS

Figure 1:
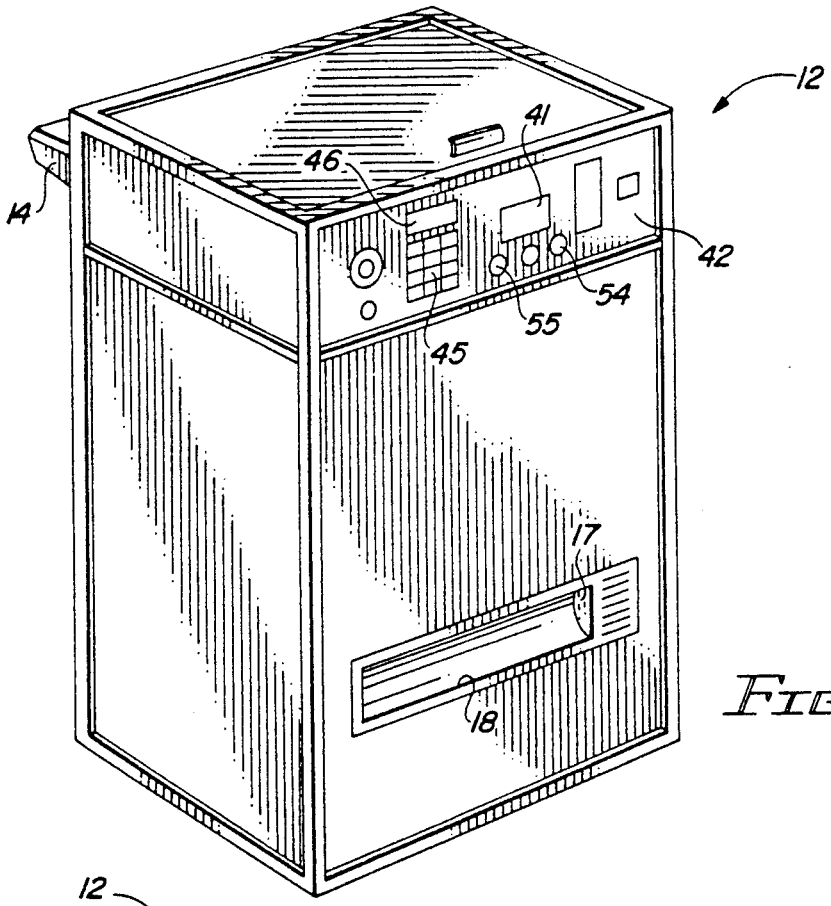
FIG. 1 is a perspective view of a processor in which a lockout system in accordance with the present invention can be employed.

The principles of the invention are illustrated, by way of example, embodied in the form of a lockout system 10 (FIG. 3) suitable for use with a processor 12 (FIGS. 1 and 2) for the automatic processing of photosensitive media in the form of sheets of film F (FIG. 2), such as for the development of radiographic images for medical diagnostic purposes.

Figure 2:
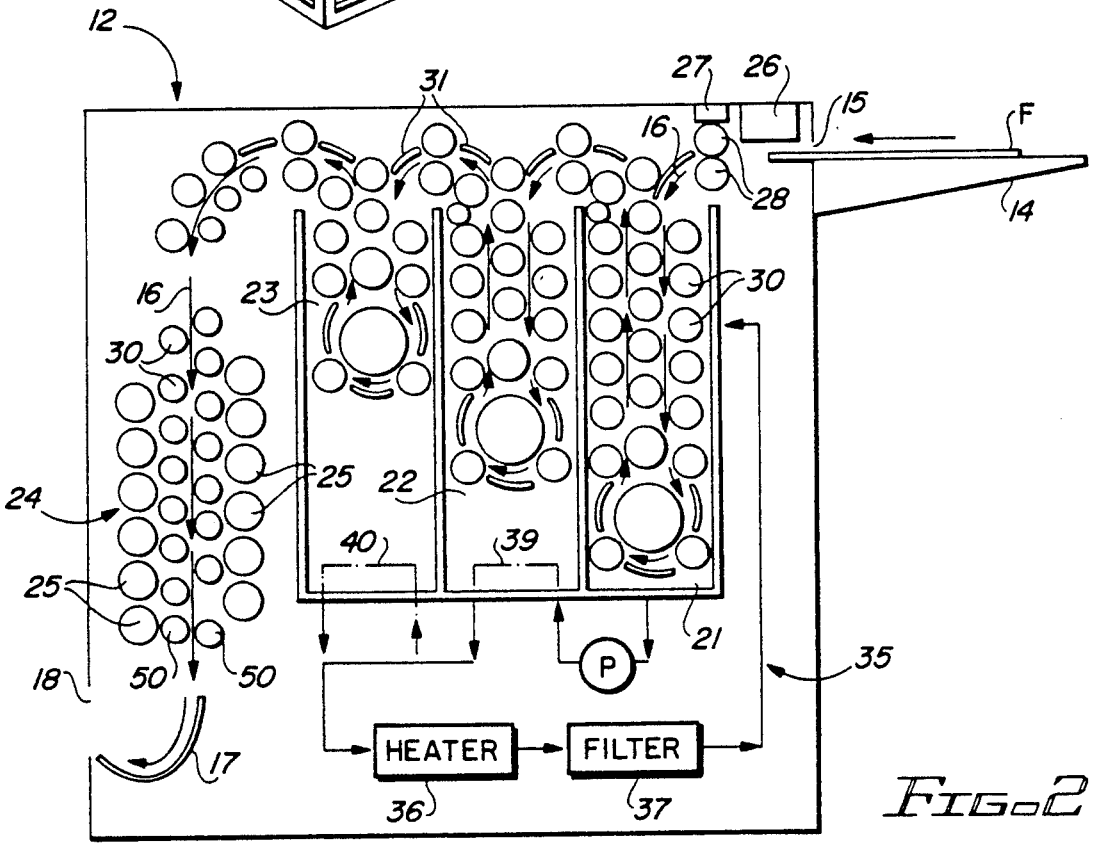
FIG. 2 is a schematic representation of relevant elements of the processor of FIG. 1.

The processor 12 has a feed shelf 14 positioned ahead of an entrance opening 15 (FIG. 2). The front end of the processor 12 including feed shelf 14 and entrance opening 15 is located in a darkroom to avoid unwanted exposure of sheets of photosensitive film F fed into the processor 12. The remaining portion of the processor 12 may be outside the darkroom. Sheets F entered through entrance opening 15 are transported through the processor 12 along a travel path 16 (indicated by arrows), and are eventually driven out of the back end of processor 12 into a catch bin 17 at an exit opening 18.

The processor 12 includes a developing station comprising a tank 21 filled with developer chemical; a fixing station comprising a tank 22 filled with fixer chemical; and a wash station comprising a tank 23 filled with wash water or comprising some other appropriate film washing device. Processor 12 also includes a drying station 24 comprising oppositely-disposed pluralities of air dispensing tubes 25 or some other appropriate film drying mechanism.

Positioned proximate opening 15 is a sensor 26, such as a conventional reflective infrared sensor array which provides signal indicative of sheet width when a sheet F is presented at the entrance opening 15. The film width sensor 26 also provides an indication of the occurrence of passage of the leading edge and trailing edge of each sheet past point 26 of the processor 12, since the signal from the sensor 26 will change significantly as each leading and trailing edge is encountered. A second sensor 27, in the form of a reed switch or the like, may be provided to detect separation of the entrance rollers 28 to signal the beginning of transportation of a sheet of film along the path 16.

In FIG. 2, the sheet path 16 is shown as defined by a plurality of film transport rollers 30 and a plurality of guide shoes 31 located to direct a sheet of film F sequentially through the tanks 21, 22, 23 and dryer 24. The rollers 30 form the transport system for transporting the sheets F through the processor 12. Crossover assemblies act at the interfaces between the respective tanks 21, 22, 23 and dryer 24 to transport sheets between the corresponding stations. Rollers 30 may be driven in conventional manner by a common drive shaft 33 (FIG. 3) having alternating right-hand and left-hand axially-spaced worms for driving adjacent columns of rollers 30 at the same speed in counterrotation, so as to move the sheets F in the direction of the arrows along path 16. Drive shaft 33 may be connected by a chain and toothed sprockets (not shown) to be driven by an electric motor 34.

The temperature of developer chemical in tank 21 may be controlled by means of a recirculation plumbing path 35 (FIG. 2) having a pump P for drawing developer out of tank 21, through a thermowell or other suitable heating device 36, through a filter 37, and then passing it back to the tank 21. A temperature sensor 37 (FIG. 3) is provided in the tank 21 or recirculation path 35 to monitor the temperature of the developer. The sensor 37 may, for example, be a thermocouple provided in a thermowell 36. Developer temperature may be displayed on a meter 41 located on an exterior control panel 42 of the processor 12. Temperature control of fixer chemistry (and wash water, if desired) may be conveniently provided by passing an immersed loop 39 (and optional loop 40 shown in dot-dashed lines) through the fixer tank 22 (and wash tank 23). The loop will serve to control the less critical temperature of the fixer (and wash water) through heat exchange with the more closely controlled temperature of the developer flowing in the path 35. It will be appreciated that other ways of controlling processor chemistry temperatures may be employed.

Figure 3:
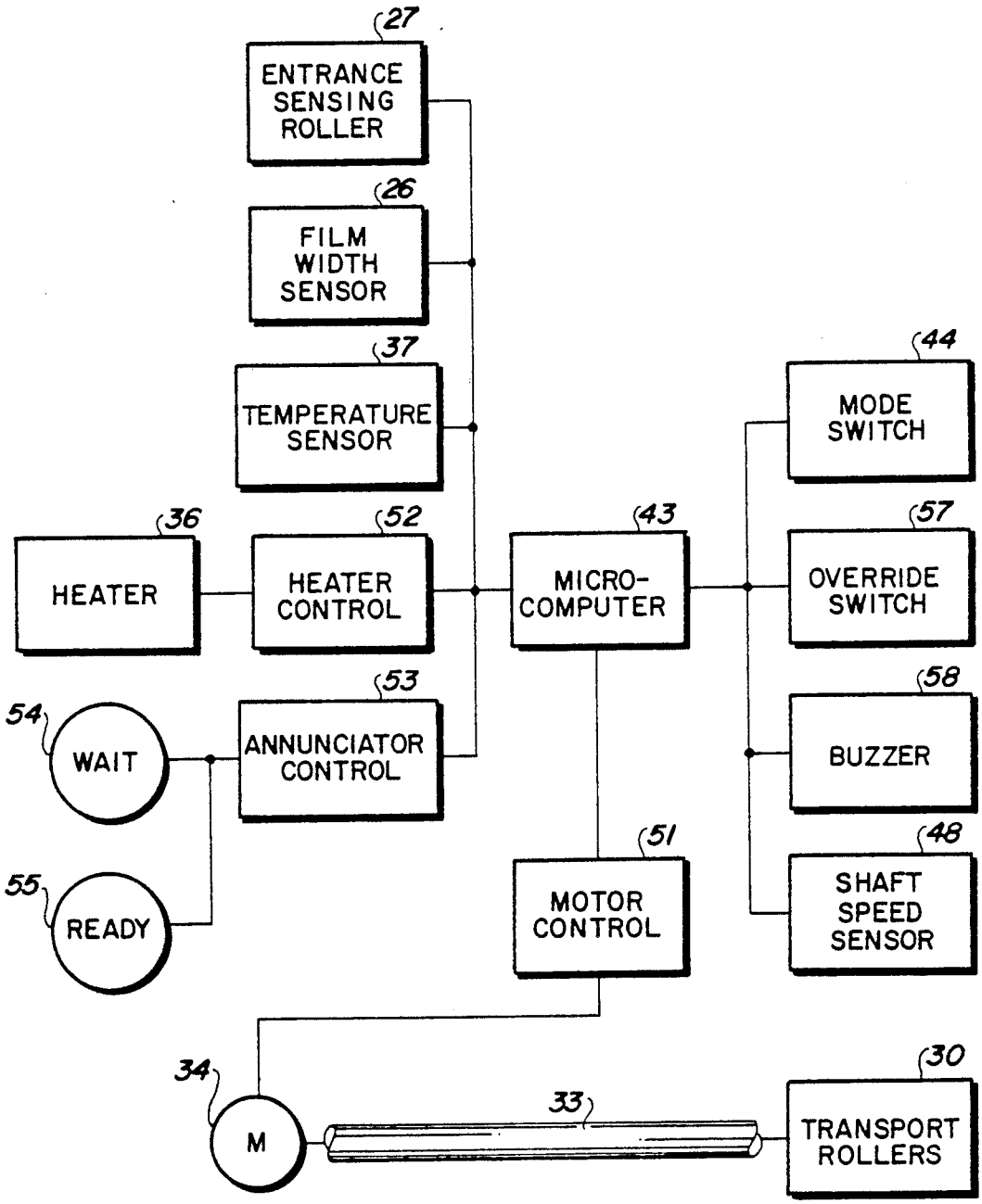
FIG. 3 is a block diagram of the lockout system employed in the processor of FIGS. 1 and 2.

FIG. 3 illustrates a control system usable in implementing an embodiment of the present invention. As shown in FIG. 3, a microcomputer 43 is connected to direct the operation of the processor 12. Microcomputer 43 receives manual input from the user through a mode switch 44 as to what processor mode of operation is desired. The system can be configured to enable the user to select among predesignated modes, such as standard, rapid, "Kwik," or extended modes having predetermined associated film path speed and chemistry temperature parameters; and can also be configured to permit a user to set a desired path speed and temperature directly. One way to implement mode switch 44 is by means of an alphanumeric keypad 45 and keypad display 46 (FIG. 1) for providing programming communication between the user and the microcomputer 43. For example, a function code can be entered to signal that mode selection is being made, followed by a selection code to designate the selected mode. Alternatively, a function code can be entered for film path speed or chemistry temperature, followed by entry of a selected speed or temperature setting. Another way to implement switch 44 is by means of a plurality of push button or toggle switches, respectively dedicated one for each selectable mode, and which are selectively actuated by the user in accordance with user needs.

Microcomputer 43 is connected to receive other input information from the film width sensor 26, the entrance roller sensor 27, the developer temperature sensor 37 and, optionally, from a shaft speed sensor 48. Shaft speed sensor 48, which may comprise a shaft encoder mounted for rotation with drive shaft 33 and an associated encoder sensor, provides feedback information about the speed of the common shaft 33 that uniformly drives the transport rollers 30 (FIG. 2). This gives the speed with which film is driven along the film transport path 16. The width sensor 26 provides the microcomputer 43 with information on the leading and trailing edge occurrences and the width of a film sheet F. This can be used together with film speed from sensor 48 to give a cumulative film development area total that guides the control of chemistry replenishment. The entrance roller sensor 27 signals when a film sheet leading edge has been picked up by the roller path 16. This information can be used together with film speed from sensor 48 and known length of the total path 16 from entrance rollers 28 to exit rollers 50 (FIG. 2), to indicate when a sheet of film is present along the path 16.

In accordance with the invention, microcomputer 43 is shown in FIG. 3 connected to motor control circuitry 51, heater control circuitry 52, and annunciator control circuitry 53. Motor control circuitry 51 is connected to motor 34 to control the speed of rotation of drive shaft 33. This controls the speed of travel of a film sheet F along the film path 16 and, thus, determines the length of time sheet F spends at each of the stations (viz. controls development time). Heater control circuitry 52 is connected to the heater 36 to control the temperature of the developer flowing in the recirculation path 35 (FIG. 2) and, thus, the temperature of developer in tank 21, fixer in tank 22 and, optionally, wash water in tank 23. Annunciator control circuitry 53 is connected to annunciators in the form of "Wait" light 54 and "Ready" light 55 to control the on/off cycles of the same. Identical "Wait" and "Ready" lights 54, 55 (for example, LED's) may be provided on both the darkroom (not shown) and lightroom (see control panel 42 in FIG. 1) sides of the processor 12.

Figure 4:
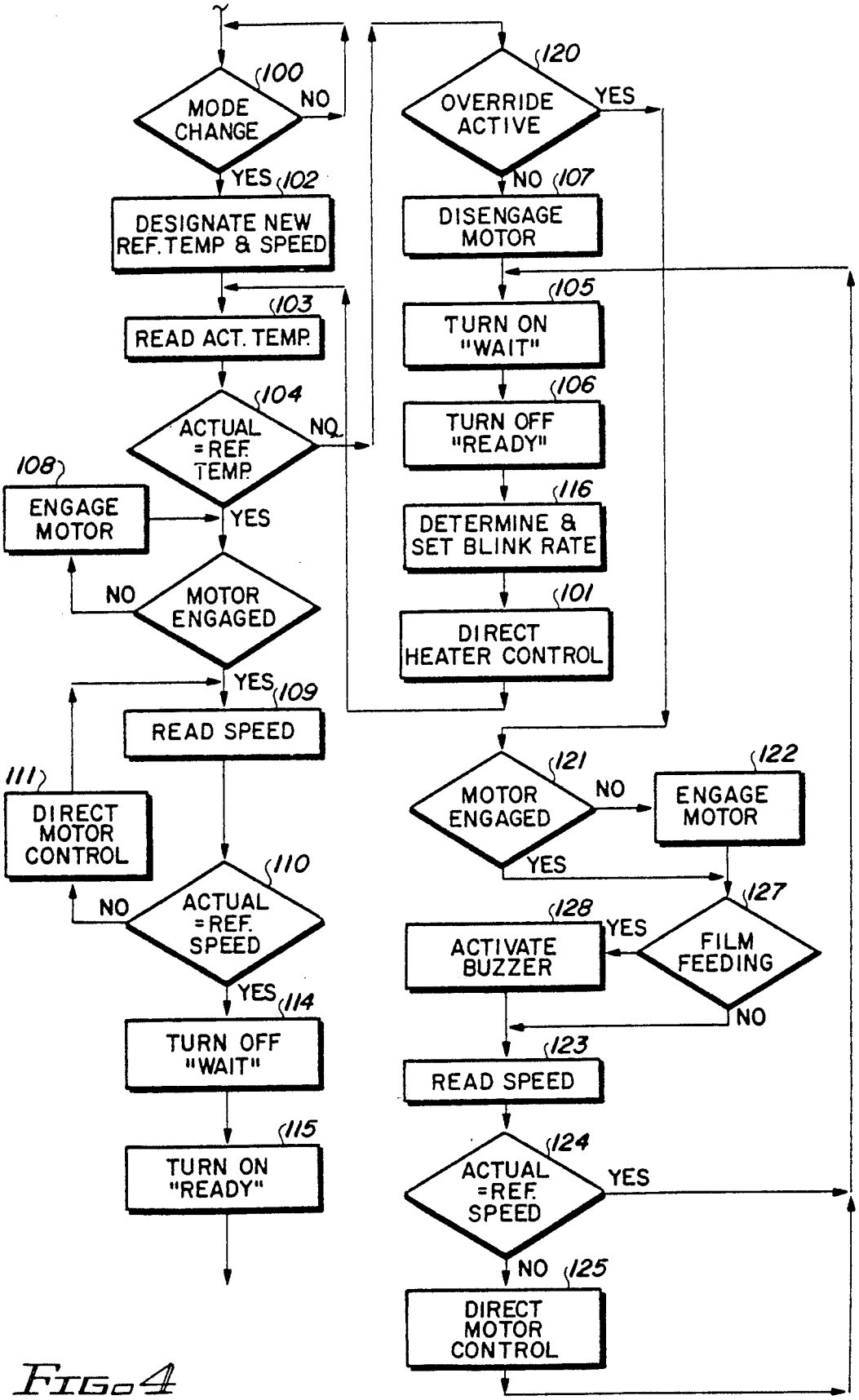
FIG. 4 is a flow diagram of the operation of the system of FIG. 3.

In operation, as indicated in the flow diagram of FIG. 4, a user-designated mode change selected at keypad 45 (FIG. 1) or other mode switch 44 (FIG. 3) is input to microcomputer 43 (100) to cause a designation (through look-up table, algorithm or the like) of reference developer temperature and transport speed parameters recommended for the selected mode (102). Motor and heater control circuits 51, 52 are then directed to control the motor 34 and heater 36 to bring the actual developer temperature and film path transport speed as sensed by sensors 37 and 48 into line with the designated reference temperature and speed. A change of speed can be achieved quickly; however, temperature change will take considerably longer.

As shown in FIG. 4, if actual temperature from sensor 37 (103) is not within an acceptable temperature range close to reference temperature, the "wait" light 54 is turned "on" (105) and the "ready" light 55 (104) is switched off (106). In accordance with one aspect of the invention, a temperature differential beyond the acceptable range also causes the transport motor 34 to be disengaged (107), thereby preventing any new film sheets F from being fed into the processor 12. The comparison of actual and reference temperatures continues, until the actual temperature is within an acceptable tolerance of reference temperature (101, 103, 104). The motor 34 is then re-engaged (108) and actual motor speed (viz. film transport speed) is brought into line with the reference motor speed (109, 110, 111). The "wait" light 54 is then switched off (114) and the "ready" light 55 switched on (115).

In accordance with another feature of the invention, the magnitude of the difference between actual and reference temperatures is determined (116) and utilized by microcomputer 43 to direct the annunciator control circuit 53 to blink one or both of the lights 54, 55 at a frequency depending on the magnitude. The "wait" light 54 may, for instance, be caused to blink at a slow frequency (mostly "off"), with the "ready" light "on," for a large differential; to blink at a medium frequency ("off" as much as it is "on") for a smaller differential; and to blink at a very high frequency (mostly "on") for an even smaller differential. Finally, when the temperature differential is small enough to place the actual temperature within an acceptable range, the "wait" light 54 is switched completely "off" (114) and the "ready" light 55 is switched on (115). The microcomputer 43 can signal this at about the same time as a signal is passed to reactivate the motor (107, 108). The blinking circuitry can take any number of forms in accordance with known timing circuit principles, with separate circuits being activated for each different temperature differential stage, if desired.

Another feature of the invention provides a manual override to the temperature lockout. An override switch 57 (FIG. 3), which may be implemented by the same keypad 45 discussed above for the mode switch 44, is connected to provide microcomputer 43 with a signal flagging user preference to not deactivate the motor 34 when the conditions for temperature lockout are present. Activation of override switch 57 (120) causes the motor to be re-engaged, if not engaged (121, 122) and motor speed to be brought up to reference speed (123, 124, 125). The lights 54, 55 will still operate in the same manner as in the absence of activation of switch 57 (105, 106, 116), but the motor will remain active to transport sheets fed into the processor 12 at entrance 15 through the machine. The heater control circuit 52 will continue to be driven by the microcomputer 43 to bring the actual developer temperature into line with the reference temperature (101, 103, 104). The override feature may, for example, be useful where developed images are needed quickly, even though there is risk that they will be at degraded quality. The user can actuate the override switch 57 and watch the blinking wait light 54, to make a decision if and when to feed new sheets F into the processor 12. One choice might, for example, be to wait until the "wait" light 54 is blinking at a fast, or even medium, frequency before inserting the sheets in an override situation. Of course, where function programming is utilized, microcomputer 43 can be set through the pad 45 to lockout film sheets completely (i.e., disengage motor 34) only when the "wait" light 54 is flashing at slow and medium, or just slow frequencies.

Other annunciators, such as a buzzer 58, can be connected to the microcomputer 43 to be actuated whenever sensor 26 indicates an attempt to feed a fresh sheet F at entrance 15 and a "ready" condition does not exist, i.e., actual chemistry temperature is not within an acceptable range for the selected mode (see 127, 128 in FIG. 4).

Those skilled in the art to which the invention relates will appreciate that other substitutions and modifications can be made to the described embodiments without departing from the spirit and scope of the invention as described by the claims below.

What is claimed is:

1. In apparatus for the processing of exposed photosensitive media, said apparatus having means for automatically transporting said media from a feed point along a path through developer, fixer, wash and dryer stations, and means for regulating the temperature of developer located at said developer station in accordance with a reference temperature and in response to a temperature sensor, the improvement comprising:

said apparatus further including a control panel, means responsive to user input at said control panel for selectively resetting said reference temperature to a different reference temperature; and means, responsive to said selectively resetting means and said temperature sensor, for automatically inhibiting the introduction of further media from said feed point along said path until actual developer temperature measured by said sensor is within a predefined acceptable range of said different reference temperature.

2. The improvement as in claim 1, wherein said means for transporting comprises a plurality of transport rollers and a motor for driving said rollers, and said means for inhibiting comprises means for inhibiting said motor from driving said rollers.

3. The improvement as in claim 2, further comprising an annunciator, and wherein said means for inhibiting further comprises means for actuating said annunciator to signal a user that said actual developer temperature is outside of said acceptable range.

4. The improvement as in claim 3, further comprising means for modulating said annunciator to signal the extent to which said actual developer temperature is near said predefined acceptable range.

5. The improvement as in claim 3; wherein said annunciator comprises at least one light for indicating a "wait" or "ready" status.

6. The improvement as in claim 2, further comprising means for manually overriding said means for inhibiting said motor from driving said rollers.

7. The improvement as in claim 6, further comprising a sensor for detecting the presence of said media at said feed point; an annunciator; and means, responsive to detection of said presence by said annunciator when said means for inhibiting is overridden, for actuating said annunciator to signal a user that said actual developer temperature is outside of said acceptable range.

8. The improvement as in claim 1, wherein said apparatus includes a microprocessor circuit, said means for transporting comprises a plurality of transport rollers and a motor for driving said rollers, said means for regulating comprises a heater connected to said microprocessor circuit and adapted and positioned to heat the developer located at said developer station under control of said microprocessor circuit, and said means for resetting comprises means for programming said microprocessor.

9. The improvement as in claim 8, wherein said means for resetting comprises a mode switch, and means for enabling user manual input to set said mode switch.

10. The improvement as in claim 8, wherein said means for resetting comprises a user operable keypad.

11. The improvement as in claim 8, wherein said motor is connected to be driven under control of said microprocessor circuit, said apparatus is configured to operate at a selected one of a plurality of modes defined by a different set of roller speed and reference temperature parameters, and said means for resetting comprises means for selecting one of said modes and programming said microprocessor according to the selected mode to control said motor and said heater in accordance with said respective parameters corresponding to said mode.

12. Apparatus for the processing of exposed photosensitive media, comprising:

a developer tank for the containment of developer;

means for automatically transporting said media along a path through said developer tank;

means for sensing the actual temperature of the developer contained in said tank;

means for defining a reference temperature in response to user input;

means for regulating the temperature of the developer in accordance with said reference temperature in response to said sensed actual temperature; and means for automatically inhibiting said means for transporting to prevent the transport of further media along said path when said actual temperature is not within a predefined acceptable range of said reference temperature.

13. Apparatus as in claim 12, wherein said means for transporting comprises a plurality of transport rollers and a motor for driving said roller, and said means for inhibiting comprises means for inhibiting said motor from driving said rollers.

14. Apparatus as in claim 13, further comprising means for manually overriding said means for inhibiting said motor from driving said rollers.

15. A method for automatically maintaining quality control over processing of exposed photosensitive media in apparatus having means for automatically transporting said media at a transport speed from a feed point along a path through developer, fixer, wash and dryer stations, and means for regulating the temperatures of developer located at said developer station in accordance with a reference temperature and in response to a temperature sensor, comprising the steps of:

defining said reference temperature in response to suer selection of a processor operating mode;

measuring the actual temperature of the developer with said temperature sensor;

automatically adjusting the actual temperature of the developer by said means for regulating to bring it into line with said defined reference temperature; and automatically inhibiting the introduction of further media from said feed point along said path until said measured actual temperature is within a predefined acceptable range of said reference temperature.

16. A method as in claim 15, further comprising the step of defining said transport speed in response to said user selection of said operating mode.

17. A method as in claim 16, wherein said means for transporting comprises a plurality of transport rollers and a motor for driving said rollers, and said inhibiting step comprises inhibiting said motor from driving said rollers.

18. A method as in claim 17, wherein said inhibiting step further comprises providing an annunciator, and actuating said annunciator to signal a user the extent to which said measured actual temperature is near said acceptable range.

19. A method as in claim 18, further comprising the step of modulating said annunciator to signal the nearness of said measured actual temperature to within said acceptable range.

20. A method as in claim 18, wherein said annunciator is at least one light for indicating a "wait" or "ready" status.

* * * * *